US006917347B2

(12) United States Patent
Long et al.

(10) Patent No.: US 6,917,347 B2
(45) Date of Patent: Jul. 12, 2005

(54) PAINTED BROADCAST-FREQUENCY REFLECTIVE COMPONENT

(75) Inventors: Lynn E. Long, Manhatten Beach, CA (US); James F. Cordaro, Ridgecrest, CA (US)

(73) Assignee: The Boeing Company, Chicago, IL (US)

( * ) Notice: Subject to any disclaimer, the term of this patent is extended or adjusted under 35 U.S.C. 154(b) by 23 days.

(21) Appl. No.: 10/389,546

(22) Filed: Mar. 14, 2003

(65) Prior Publication Data

US 2004/0178967 A1 Sep. 16, 2004

(51) Int. Cl.[7] ..... H01Q 15/14; H01Q 13/00

(52) U.S. Cl. ..... 343/912; 343/781 CA; 343/909

(58) Field of Search ..... 343/912, 909, 343/781 CA, 781 R, 781 P; H01Q 15/14, 13/00

(56) References Cited

U.S. PATENT DOCUMENTS 5,543,814 A * 8/1996 Jenness, Jr. ..... 343/840
5,807,909 A * 9/1998 Cordaro et al. ..... 523/179
5,820,699 A * 10/1998 Asahi et al. ..... 148/325
5,993,906 A * 11/1999 Smith et al. ..... 427/316
6,099,637 A * 8/2000 Cordaro ..... 106/635
6,124,378 A * 9/2000 Cordaro et al. ..... 523/179
6,273,592 B1 * 8/2001 Herst et al. ..... 362/342
6,456,253 B1 * 9/2002 Rummeli et al. ..... 343/839
2001/0044013 A1 * 11/2001 McDonough et al. ..... 428/202

* cited by examiner

*Primary Examiner*—Trinh Vo Dinh
(74) *Attorney, Agent, or Firm*—McNees Wallace & Nurick LLC; Gregory O. Garmong; Carmen Santa Maria

(57) ABSTRACT

A component that is reflective for broadcast-frequency energy includes a nonmetallic substrate having a substrate surface, and a layered coating overlying and contacting the substrate. The layered coating has an electrically conductive layer overlying and contacting the substrate surface, and a layer of a white paint overlying and contacting the electrically conductive layer. The white paint is formed of a plurality of particles including a plurality of pigment particles. Each pigment particle has a composition of $A[xAl(1-x)Ga]_2O_4(\delta D)$, A is selected from the group consisting of zinc, cadmium, and magnesium, D is a dopant selected from the group consisting of a cationic dopant having an ionic valence greater than +2 and an anionic dopant, the value of x is from 0 to 1, and the value of $\delta$ is from 0 to about 0.2. The paint further includes an inorganic or an organic binder mixed with the particles to form a mixture.

19 Claims, 2 Drawing Sheets

PAINTED BROADCAST-FREQUENCY REFLECTIVE COMPONENT

This invention relates to components that are highly reflective of broadcast-frequency energy, such as antennas.

BACKGROUND OF THE INVENTION

Broadcast-frequency antennas are important components of most spacecraft. For example, a communications satellite in geosynchronous orbit receives a broadcast-frequency communications signal up-linked from a ground antenna with an onboard broadcast-frequency antenna, amplifies the received signal, and then down-link transmits the amplified broadcast-frequency signal back to earth using a different onboard broadcast-frequency antenna. Other types of spacecraft also conduct most of their communications with earth stations and with each other using onboard broadcast-frequency antennas.

Each antenna has at least one broadcast-frequency antenna reflector, which operates by reflecting a broadcast-frequency signal either to (for signals being received) or from (for signals being transmitted) a broadcast-frequency transceiver. Each antenna reflector must be functional to reflect high power densities of broadcast-frequency signals, but it must, like other spacecraft components, be as light as possible due to the high cost of lifting loads to orbit. It must also have excellent thermal performance, inasmuch as it is heated both by the solar rays and by energy transfer from the reflected broadcast-frequency beam. Because the antenna reflector is relatively large in size, it is made to be very light in weight on an areal basis.

In one existing approach, the structure of the broadcast-frequency antenna reflector that defines its overall paraboloid or other shape is made of a light-weight composite material. Because such a material does not reflect broadcast-frequency energy well, the reflecting surface is covered with a broadcast-frequency reflective coating. The broadcast-frequency reflective coating is usually made of a multilayer coating having 3–7 layers of vacuum-deposited aluminum (VDA), silicon monoxide, and silicon dioxide. An epoxy undercoat may be applied to the composite material before applying the broadcast-frequency reflective coating to seal the porosity of the composite material and to provide a smooth surface for the deposition of the broadcast-frequency reflective coating. Before coating with the broadcast-frequency reflective coating, the surface of the composite material is abraded if there is no epoxy undercoat or grit blasted if an epoxy undercoat is used, to impart sufficiently low specularity to its surface.

The conventional antenna reflector is functional, but it is difficult and expensive to manufacture due to the difficulty in, and expense associated with, applying the multilayer coating system in a reproducible fashion. The thermal, electrostatic discharge (ESD), and specular properties of the antenna reflector therefore vary from antenna reflector to antenna reflector. At least some, and often all, of the layers of the multilayer coating are applied in a vacuum to a complexly shaped surface, and it is difficult to achieve uniform thin coatings by this approach. The thermal-radiative properties of the conventional multilayer coating are not as good as desired, and the ESD performance is not good for some embodiments. It is difficult to precisely control the layer thicknesses to achieve the proper balance of the properties. Further, it is difficult to achieve the required low-diffuseness, textured surface on the coating, which is required to ensure that the thermal energy of the sun is not focused on the sub-reflector (if a Cassegrain antenna) and other feed components of the broadcast-frequency antenna. If there is too much abrading or grit blasting, the deposited VDA layer is not smooth and continuous, which is required for good broadcast-frequency properties. In short, the fabrication of the conventional broadcast-frequency antenna is expensive, time-consuming, difficult to perform, difficult to reproduce, and in many cases, the resulting properties are only marginally acceptable.

There is a need for an improved approach to the fabrication of broadcast-frequency antenna reflectors and other components for spacecraft and for other applications where the article must be broadcast-frequency reflective, be light in weight, and have the necessary thermal-radiative and ESD properties. The present invention fulfills this need, and further provides related advantages such as few process steps and less complexity in the fabrication process.

SUMMARY OF THE INVENTION

The present approach provides a broadcast-frequency reflective component that is much more readily and less expensively manufactured than the conventional broadcast-frequency reflective component. There is better reproducibility of the processing, reducing the variability between components. The thermal-radiative and solar diffuseness performance of the broadcast-frequency reflective component are superior to those of conventional broadcast-frequency reflective components, and the ESD performance is comparable. The superior thermal performance of the present approach means that the antenna or other component operates at a significantly lower temperature than does the prior antenna, an important consideration because an excessively high temperature may lead to warping and/or weakening of the composite material substrate.

In accordance with the invention, a component that is reflective for broadcast-frequency energy comprises a non-metallic substrate having a substrate surface, and a layered coating overlying and contacting the substrate. Optionally but preferably, an undercoat is present at the substrate surface to seal its porosity and smooth it. The layered coating comprises an electrically conductive layer overlying and contacting the substrate surface, and a layer of a white paint overlying and contacting the electrically conductive layer. The white paint comprises a plurality of particles comprising a plurality of pigment particles, wherein each pigment particle has a composition of $A[xAl(1-x)Ga]_2O_4$ ($\delta D$). In this relation, A is zinc, cadmium, and magnesium (or combinations thereof), D is a dopant selected from the group consisting of a cationic dopant having an ionic valence greater than +2 and an anionic dopant, the value of x is from 0 to 1, and the value of $\delta$ is from 0 to about 0.2. A binder is mixed with the particles to form a mixture, wherein the binder is an organic binder or an inorganic binder.

In the application of most interest, the substrate has a shape defining a broadcast-frequency antenna reflector, and in particular a broadcast-frequency Cassegrain antenna reflector. The substrate preferably is constructed from a composite material such as a graphite/epoxy composite material, preferably but not necessarily with an epoxy layer thereon defining the substrate surface.

The electrically conductive layer may be of any operable type. The preferred electrically conductive layer is a deposited metallic layer, such as vacuum deposited aluminum. The layer of the white paint preferably has a thickness of from about 0.0005 to about 0.002 inch.

A method for providing a component that is reflective for broadcast-frequency energy comprises the steps of preparing a nonmetallic substrate having a substrate surface, and applying a layered coating overlying and contacting the substrate. The layered coating is preferably as described herein, with the electrically conductive layer applied by metallic deposition and the paint layer applied by painting and drying. Additionally, a beam of broadcast-frequency energy may be directed against the component, which is preferably a broadcast-frequency antenna reflector.

The present approach has numerous advantages as compared with the conventional approach of the multilayer coating with 3–7 layers of vacuum deposited aluminum, silicon monoxide, and silicon dioxide. The present approach is much more readily implemented, at significantly less cost. The electrically conductive layer is preferably applied by vacuum deposition. The white-paint layer is easily applied to the electrically conductive layer, preferably by a painting technique such as spraying. The thermal radiative properties and electrostatic discharge properties of the white paint layer provide the coated component protection against excessive heat buildup and electrostatic charge buildup, so that the present component operates at a significantly lower temperature and with less risk of charge buildup than a conventionally coated antenna reflector. The upper layers of the conventional multilayer coating are dielectric and build up electrical charges thereon. The white paint also has a low specular diffuseness to scatter solar radiation rather than reflect it to the other components of the antenna. By comparison, conventionally produced antenna reflectors must be heavily abraded or grit blasted to give them a low-diffuseness, low-specularity surface, and the abrading and grit blasting are difficult to control and make uniform across the surface of the antenna reflector. Because of the reduced complexity of the present approach, the time to fabricate a 6-foot diameter parabolic antenna is 3–4 days for the present approach and 3–4 weeks for the prior approach.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
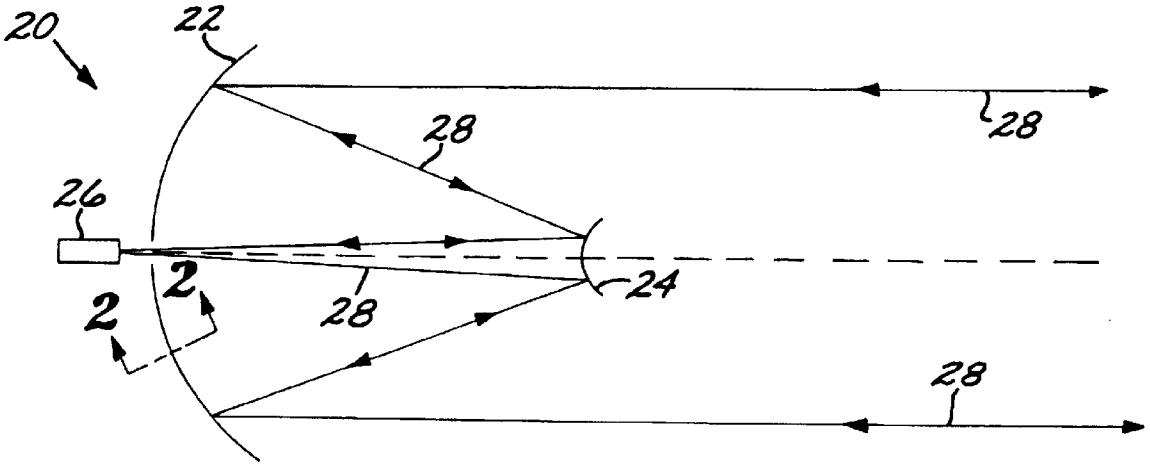
FIG. 1 is a schematic elevational view of a Cassegrain antenna system.

FIG. 1 depicts a Cassegrain broadcast-frequency antenna 20, a preferred application of the present approach, in general form. This Cassegrain antenna 20 is used to transmit or receive broadcast-frequency signals. The Cassegrain antenna 20 includes a paraboloid main antenna reflector 22, a sub-reflector 24, and a broadcast-frequency transceiver 26. Illustrative transmitting/receiving beam paths 28 are shown. Cassegrain antennas 20 are known in the art, except for the modifications discussed herein.

Figure 2:
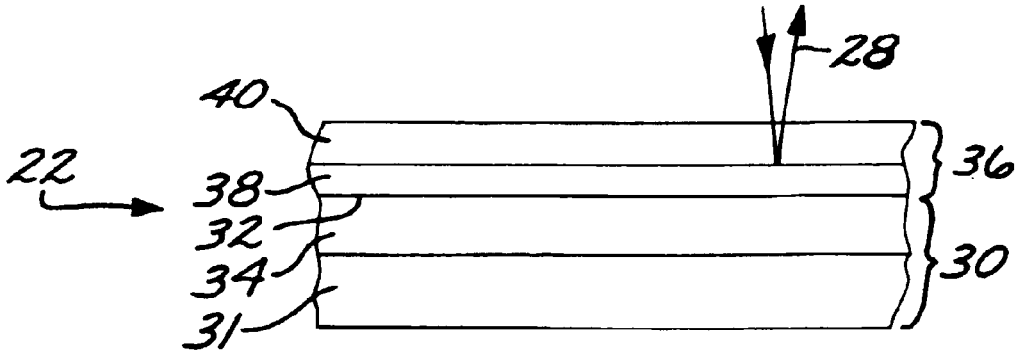
FIG. 2 is a schematic sectional view through the main broadcast-frequency antenna reflector of FIG. 1.
Figure 4:
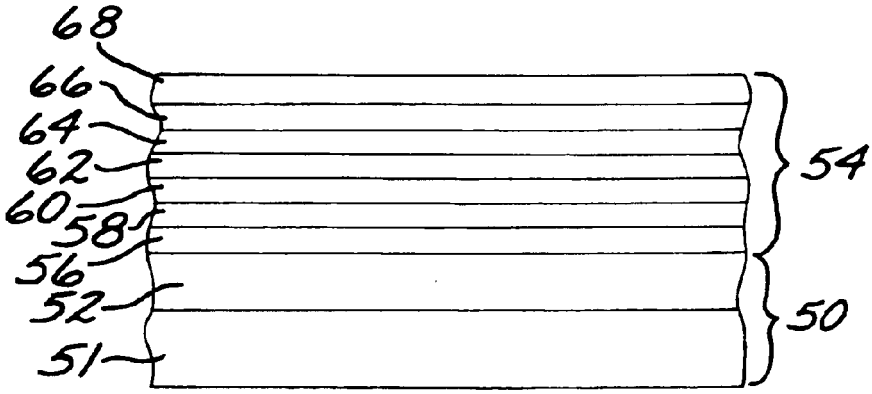
FIG. 4 PRIOR ART
FIG. 4 is a schematic sectional view through an antenna reflector, illustrating the conventional (prior art) structure of the main antenna reflector.

FIG. 2 is a sectional view through the main antenna reflector 22 to show its construction, illustrating an embodiment of the present approach. (The thicknesses of the various structural elements and layers depicted in FIGS. 2 and 4 are not to scale.) The main antenna reflector 22 includes a nonmetallic substrate 30 having a substrate surface 32. The substrate 30 is a structural element whose shape defines the overall shape of the broadcast-frequency main antenna reflector, which may be a parabola, segment of a sphere, or other shape. The substrate 30 preferably includes a composite-material base material 31. The composite-material base material 31 is most preferably a graphite/epoxy composite material formed of graphite fibers embedded in and reinforcing a cured epoxy matrix. In a typical case wherein the main antenna reflector 22 has a diameter of 5–6 feet, the composite-material base material is about 0.030 to about 0.060 inches thick. Because the surface of the composite material may have some surface porosity and/or be patterned in an undesirable manner as a result of its manufacture, it is preferred to provide an undercoat layer 34 of an unreinforced organic material overlying and contacting the base material 31, and it is the surface of this undercoat layer 34 that is the substrate surface 32. The undercoat layer 34 is preferably made of unreinforced cured epoxy in the case where the substrate 30 is graphite/epoxy composite material, and the undercoat layer 34 is preferably from about 0.0002 (which may be applied as a rubbed-on undercoat) to about 0.0015 inch thick (which may be applied as a sprayed-on undercoat).

A layered coating 36 overlies and contacts the substrate surface 32 of the substrate 30. The layered coating 36 comprises an electrically conductive layer 38 overlying and contacting the substrate surface 32. The electrically conductive layer 38 is of any operable type. Preferably the electrically conductive layer 38 is a deposited metallic layer. In this case, the electrically conductive layer 38 is preferably a layer of vacuum-deposited aluminum from about 1,500 to about 6,000 Angstroms thick.

A layer of a white paint 40 overlies and contacts the electrically conductive layer 38. The white paint comprises a plurality of particles comprising a plurality of pigment particles. Each pigment particle preferably has a composition of $A[xAl(1-x)Ga]_2O_4(\delta D)$, where A is selected from the group consisting of zinc, cadmium, and magnesium, D is a dopant selected from the group consisting of a cationic dopant having an ionic valence greater than +2 and an anionic dopant, the value of x is from 0 to 1, and the value of $\delta$ is from 0 to about 0.2. Preferably, A is zinc, the atomic ratio of Al:Ga is from about 0.6 to about 1.0, D is indium and $\delta$ is 0.1 weight percent expressed as indium oxide. A binder is mixed with the particles to form a mixture. The binder may be an organic binder or an inorganic binder. The paints and their method of preparation are disclosed more fully in U.S. Pat. Nos. 5,820,669; 5,807,909; 6,099,637; and 6,124,378, whose disclosures are incorporated by reference. The layer of the white paint 40 is preferably from about 0.0005 inch to about 0.002 inch thick.

In service, the beam path 28 passes through the layer of the white paint 40 and reflects from the electrically conductive layer 38. The layer of the white paint 40 has a low insertion loss, so that there is little attenuation of the broadcast-frequency energy as it passes through the layer of the white paint 40.

Figure 3:
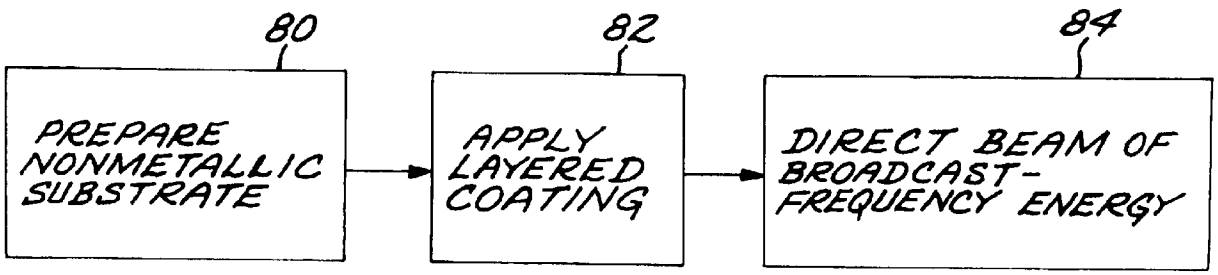
FIG. 3 is a block flow diagram of the present approach.

FIG. 3 illustrates a method for practicing the present approach. The nonmetallic substrate 30 is prepared, step 80.

In the preferred case of a composite-material nonmetallic base material 31, the base material 31 is prepared by conventional composite-material layup techniques to provide the required size and shape of the article being fabricated. In the usual case, the undercoat layer 34 is applied overlying the composite-material base material. The base material 31 and undercoat layer 34 are cured following the recommended practices for the organic materials used. No roughening of the surface of the substrate is used, because the layer of white paint that is subsequently applied is of sufficiently low diffuseness that such roughening is not required. A uniform roughening of the substrate surface by abrasion or grit blasting is required in the prior approach (to be discussed in relation to FIG. 4). It is difficult to achieve such a uniform roughening over the large surface area of the antenna, and the present approach avoids that fabrication problem.

The layered coating 36 is applied, step 82. The metallic electrically conducting layer 38 is deposited by any appropriate technique, such as vacuum deposition in the case of a vacuum-deposited aluminum layer.

The layer of white paint 40 is prepared, applied (preferably by spraying) over the electrically conductive layer 38, and cured in the manner provided in the '669, '909, '637, and '378 patents. The binder may be an inorganic silicate, or an organic compound such as a silicone, epoxy, or polyurethane. The inorganic binders produce better thermal radiative and electrical-conductivity properties than the organic binders, but the inorganic binders are more difficult to apply. The determination as to the type of binder to use depends upon the mission requirements.

The cured white paint has a low insertion loss for the broadcast-frequency energy, so that it introduces little electrical impedance to the broadcast-frequency signal. On the other hand, the white paint has a low specularity to avoid reflection of intense light into the broadcast-frequency transceiver that might damage it, has good thermal radiative properties to prevent overheating of the substrate 30 that might warp it or degrade the composite or epoxy properties, and has good ESD charge dissipation to prevent electrical charging of the coated article.

A beam of broadcast-frequency energy is directed against the finished article, step 84. As the term is used herein, "broadcast-frequency" energy preferably has a frequency of from about 100 MHZ (megahertz) to about 100 GHZ (gigahertz). The beam of broadcast-frequency energy is directed against the side of the antenna having the layer of white paint 40, passes through the layer 40, reflects from the electrically conductive layer 38, and again passes through the layer 40, as shown schematically in FIG. 2.

FIG. 4 illustrates a conventional antenna reflector structure. A base material 50 has an overlying undercoat layer 52, and then a 3–7 layer multilayer structure 54. Prior to application of the undercoat layer 52, the surface of the base material 50 is cleaned with a fine sandpaper or scotchbrite pad, which also roughens it slightly. The undercoat layer 52 is applied and thereafter grit blasted to roughen it and to reduce the specularity of the final coating. In the illustrated 7-layer multilayer structure 54, overlying the undercoat layer 52 are, successively, a silicon monoxide layer 56, a vacuum-deposited aluminum layer 58, a silicon monoxide layer 60, a vacuum-deposited aluminum layer 62, a silicon monoxide layer 64, a vacuum-deposited aluminum layer 66, and a silicon dioxide top layer 68. This complex structure requires grit blasting of the undercoat layer 52, which is difficult to perform uniformly over a large area, and then multiple vacuum deposition steps over a large area such as the 5–6 foot diameter antenna. In this prior approach, multiple layers of silicon monoxide are preferred to increase the emissivity of the multilayer coating 54, and multiple layers of the vacuum-deposited aluminum are preferred to bleed off excess electrical charge. A three-layer embodiment of the prior coating structure may be used, having only one vacuum-deposited aluminum layer and one silicon monoxide layer, but its thermal properties, solar absorptance, and emittance are not as good as the illustrated seven-layer embodiment. In the present approach, by contrast, only a single electrically conductive layer and a single white-paint layer provide excellent performance in thermal, broadcast-frequency, and ESD properties.

The present invention has been reduced to practice using test panels prepared in the manner discussed above, with various types of white-paint layers.

In a first test series, test panels were prepared with the white paint having a potassium silicate inorganic binder, and test panels were prepared with the white paint having a silicone organic binder, in various cured paint thicknesses. Thermal radiative properties were measured as follows:

| Binder | Cured Thickness (in) | Solar Absorptance | Total Normal Emittance |
|---|---|---|---|
| Inorganic | 0.0013–0.0018 | 0.1184 | 0.896 |
| Inorganic | 0.0022–0.003 | 0.0938 | 0.901 |
| Organic | 0.001–0.0012 | 0.2717 | 0.816 |
| Organic | 0.002–0.003 | 0.1894 | 0.843 |

For comparison, three-layer and seven-layer embodiments of the prior approach of FIG. 4 were prepared and measured in the same manner.

| No. of Layers | Solar Absorptance | Total Normal Emittance |
|---|---|---|
| Three | 0.32–0.45 | 0.55–0.57 |
| Seven | 0.36–0.38 | 0.51–0.54 |

An important consideration for thermal performance is maintaining the ratio of (solar absorptance/total normal emittance) as low as possible. The thermal performance of the present approach, using either inorganic or organic binder in the paint, is far superior to that of the prior approach. As a result, it is expected that the antenna of the present approach will operate as much as 100° F. cooler than that of the prior approach.

Similarly prepared test panels were tested for their electrostatic discharging (ESD) performance in a simulated multiple substorm solar radiative environment at different temperatures, consisting of an 80 percentile environment for 30 minutes, a 90 percentile environment for 15 minutes, a 95 percentile environment for 10 minutes, and a 99 percentile environment for 5 minutes. The voltage on the surfaces of the test are:

| Binder | Temperature, ° C. | Voltage |
|---|---|---|
| Inorganic | −195 | 570 |
| Inorganic | −70 | 535 |
| Organic | 25 | 1036 |

-continued

| Binder | Temperature, ° C. | Voltage |
|---|---|---|
| Organic | 100 | 861 |
| Organic | −70 | 920 |

For comparison, three-layer and seven-layer embodiments of the prior approach of FIG. 4 were prepared and measured in the same manner.

| No. of Layers | Temperature, ° C. | Voltage |
|---|---|---|
| Three | −180 | <200 |
| Seven | −180 | 2000 |

All of these coatings meet their specification requirements.

A test panel having the inorganic paint and a test panel having the organic paint were cycled 20 times in a thermal shock test between −195° C. and 125° C., with no cracking or loss of paint adhesion. The three-layer and seven-layer prior art coatings also meet this requirement.

Test panels were tested for broadcast-frequency loss at a frequency of 27–40 GHZ. The losses are summarized as follows:

///

///

///

| Binder | Cured Thickness (in) | Broadcast-frequency Loss |
|---|---|---|
| Silicone | 0.001–0.0015 | −0.015 dB |
| Silicone | 0.002–0.0025 | −0.030 dB |
| Silicone | 0.0022–0.0029 | −0.030 dB |
| Inorganic | 0.0015–0.002 | −0.030 dB |

For comparison, the three-layer and seven-layer prior coatings have a broadcast-frequency loss of −0.01 dB. A loss of less than 0.1 dB is acceptable, and a loss of less than 0.05 dB is considered good, so all of the coatings meet this requirement. Thus, these broadcast-frequency losses are acceptably low for use in Cassegrain antenna reflectors. Phase shifts were less than one degree, also acceptable for use in Cassegrain antenna reflectors.

To summarize, the broadcast-frequency properties, the ESD properties and the thermal shock properties of both the present approach and the prior approach are acceptable. The thermal properties, complexity, and cost of manufacturing of the present approach are far superior to those of the prior approach.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A component that is reflective for broadcast-frequency energy, comprising:

a nonmetallic substrate having a substrate surface; and a layered coating overlying and contacting the substrate, the layered coating comprising:

an electrically conductive deposited metallic layer overlying and contacting the substrate surface, and a layer of a white paint overlying and contacting the electrically conductive layer, wherein the white paint comprises a plurality of particles comprising a plurality of pigment particles, wherein each pigment particle has a composition of $A[xAl(1-x)Ga]_2O_4(\delta D)$, A is selected from the group consisting of zinc, cadmium, and magnesium, D is a dopant selected from the group consisting of a cationic dopant having an ionic valence greater than +2 and an anionic dopant, the value of x is from 0 to 1, and the value of δ is from 0 to about 0.2, and a binder mixed with the particles to form a mixture, wherein the binder is selected from the group consisting of an organic binder and an inorganic binder.

2. The component of claim 1, wherein the substrate has a shape defining a broadcast-frequency antenna reflector.

3. The component of claim 1, wherein the substrate has a shape defining a broadcast-frequency Cassegrain antenna reflector.

4. The component of claim 1, wherein the substrate comprises a composite material.

5. The component of claim 1, wherein the nonmetallic substrate includes an undercoat layer at the substrate surface.

6. The component of claim 1, wherein the substrate comprises a graphite/epoxy composite material and an epoxy layer thereon defining the substrate surface.

7. The component of claim 1, wherein the electrically conductive layer is a vacuum-deposited aluminum layer.

8. The component of claim 1, wherein the Al:Ga atomic ratio is from about 0.6 to about 1.0.

9. The component of claim 1, wherein the layer of the white paint has a thickness of from about 0.0005 to about 0.002 inch.

10. A component that is reflective for broadcast-frequency energy, comprising:

a nonmetallic composite-material substrate having a substrate surface and a shape defining a broadcast-frequency antenna reflector; and a layered coating overlying and contacting the substrate, the layered coating comprising:

an electrically conductive deposited metallic layer overlying and contacting the substrate surface, and a layer of a white paint overlying and contacting the electrically conductive deposited metallic layer, wherein the white paint comprises a plurality of particles comprising a plurality of pigment particles, wherein each pigment particle has a composition of $A[xAl(1-x)Ga]_2O_4(\delta D)$, A is selected from the group consisting of zinc, cadmium, and magnesium, D is a dopant selected from the group consisting of a cationic dopant having an ionic valence greater than +2 and an anionic dopant, the value of x is from 0 to 1, and the value of δ is from 0 to about 0.2, and a binder mixed with the particles to form a mixture, wherein the binder is selected from the group consisting of an organic binder and an inorganic binder.

11. The component of claim 10, wherein the substrate has a shape defining a broadcast-frequency Cassegrain antenna reflector.

12. The component of claim 10, wherein the nonmetallic substrate includes an undercoat layer at the substrate surface.

13. The component of claim 10, wherein the Al:Ga atomic ratio is from about 0.6 to about 1.0.

14. The component of claim 10, wherein the layer of the white paint has a thickness of from about 0.0005 to about 0.002 inch.

15. A method for providing a component that is reflective for broadcast-frequency energy, comprising the steps of:

preparing a nonmetallic substrate having a substrate surface; and applying a layered coating overlying and contacting the substrate by the steps of:

depositing an electrically conductive deposited metallic layer overlying and contacting the substrate surface, and painting a layer of a white paint overlying and contacting the electrically conductive layer, wherein the white paint comprises a plurality of particles comprising a plurality of pigment particles, wherein each pigment particle has a composition of $A[xAl(1-x)Ga]_2O_4(\delta D)$, A is selected from the group consisting of zinc, cadmium, and magnesium, D is a dopant selected from the group consisting of a cationic dopant having an ionic valence greater than +2 and an anionic dopant, the value of x is from 0 to 1, and the value of $\delta$ is from 0 to about 0.2, and a binder mixed with the particles to form a mixture, wherein the binder is selected from the group consisting of an organic binder and an inorganic binder, wherein the nonmetallic substrate with the layered coating overlying and contacting the substrate is reflective of broadcast frequency energy.

16. The method of claim 15, wherein the step of preparing includes the step of applying an undercoat layer at the substrate surface.

17. The method of claim 15, wherein the step of preparing the nonmetallic substrate includes the step of preparing the nonmetallic substrate in a shape of a broadcast-frequency antenna reflector.

18. The method of claim 16, including an additional step, after the step of applying, of directing a beam of broadcast-frequency energy against the component.

19. The method of claim 15, wherein the step of painting includes the step of painting the layer of the white paint to a thickness of from about 0.0005 to about 0.002 inch.

* * * * *